US012644606B1

(12) United States Patent
Binek et al.

(10) Patent No.: US 12,644,606 B1
(45) Date of Patent: Jun. 2, 2026

(54) COMBUSTOR ATTACHMENT CONFIGURATION

(71) Applicant: RTX Corporation, Farmington, CT (US)

(72) Inventors: Lawrence Binek, Glastonbury, CT (US); Frederick Rosenberger, Marlborough, CT (US); Garrett Moler, Lake Park, FL (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 19/290,064

(22) Filed: Aug. 4, 2025

(51) Int. Cl.
*F23R 3/00* (2006.01)
*F23R 3/10* (2006.01)
*F23R 3/60* (2006.01)

(52) U.S. Cl.
CPC ..... *F23R 3/60* (2013.01); *F23R 3/002* (2013.01); *F23R 3/10* (2013.01)

(58) Field of Classification Search
None
See application file for complete search history.

(56) References Cited

U.S. PATENT DOCUMENTS

| | | | | |
|---|---|---|---|---|
| 2,841,958 | A * | 7/1958 | Stokes | F23R 3/60 60/800 |
| 10,174,947 | B1 | 1/2019 | Clemen | |
| 2013/0055716 | A1* | 3/2013 | Gerendas | F23R 3/60 60/722 |
| 2017/0130653 | A1* | 5/2017 | Bennett | F23R 3/343 |
| 2018/0179956 | A1* | 6/2018 | Wertz | F23R 3/005 |
| 2018/0298819 | A1* | 10/2018 | Moura | F02C 7/12 |
| 2019/0063749 | A1* | 2/2019 | Zelesky | F02C 7/12 |
| 2021/0156563 | A1 | 5/2021 | Binek et al. | |

* cited by examiner

*Primary Examiner* — Edwin Kang
(74) *Attorney, Agent, or Firm* — Kinney & Lange, P.A.

(57) ABSTRACT

A combustor liner for a gas turbine engine is disposed about an axis and defines a combustion chamber. The combustor liner includes a plurality of attachment elements circumferentially spaced about an outer wall of the combustor liner opposite the combustion chamber and a plurality of support elements connecting the plurality of attachment elements to combustor liner such that the plurality of attachment elements is radially spaced from the outer wall of the combustor liner. Each of the plurality of attachment elements includes an opening configured to slidingly receive a pin.

15 Claims, 4 Drawing Sheets

COMBUSTOR ATTACHMENT CONFIGURATION

BACKGROUND

The present disclosure relates generally to gas turbine engines and more particularly to combustor assemblies of gas turbine engines.

Gas turbine engines are continuous combustion engines that can be used for various purposes, such as power generation and/or producing thrust in an aircraft. Gas turbine engines include one or more compressor sections, one or more combustor sections, and one or more turbine sections. The compressor section receives and compresses air to increase the pressure of the air before the air reaches the combustor section. The combustor section receives the high-pressure air, mixes the high-pressure air with a fuel, and ignites the fuel and air mixture to produce exhaust gases. The exhaust gases flow from the combustor section to the turbine section where energy is extracted from the exhaust gases for use by the gas turbine engine. The combustor section of the gas turbine engine can include an outer case, a combustion liner, and a fuel delivery system. The outer case defines a duct for the high-pressure air received from the compressor section. The combustor liner is disposed within the outer case and defines a combustion chamber. The combustor liner includes openings for receiving the high-pressure air. The fuel delivery system delivers fuel to the combustion chamber.

Unitized combustors require features which position and locate the combustor liner within the outer case. Due to thermal growth, rigidly fixing the combustor liner to the outer case may result in high component stresses leading to structural failure. A need exists to provide features to position and locate the combustor liner that provide for thermal growth of the combustor liner while minimizing blockage of the high-pressure air through the outer case duct and without affecting fuel delivery to the combustion chamber.

SUMMARY

In one aspect, a combustor liner for a gas turbine engine is disposed about an axis and defines a combustion chamber. The combustor liner includes a plurality of attachment elements circumferentially spaced about an outer wall of the combustor liner opposite the combustion chamber and a plurality of support elements connecting the plurality of attachment elements to combustor liner such that the plurality of attachment elements is radially spaced from the outer wall of the combustor liner. Each of the plurality of attachment elements includes an opening configured to slidingly receive a pin.

In another aspect, a combustor assembly for a gas turbine engine includes a combustor liner disposed about an axis and defining a combustion chamber, an outer case disposed about the combustor liner, and a plurality of pins fixed to the outer case. The combustor liner includes a plurality of attachment annuli circumferentially spaced about an outer wall of the combustor liner opposite the combustion chamber and radially spaced from the outer wall of the combustor liner, a plurality of inlet scoops extending radially from the outer wall of the combustor liner, and a plurality of ligaments arranged in pairs with each pair connecting adjacent ones of the plurality of inlet scoops with a respective attachment annulus of the plurality of attachment annuli. Ligaments of each pair of ligaments converge in extension from the adjacent ones of the plurality of inlet scoops to the respective attachment annulus. Each of the plurality of attachment annuli includes a radially extending opening. The plurality of inlet scoops is configured to guide an air flow into the combustion chamber. The plurality of pins is slidingly received in the openings of the plurality of attachment annuli.

The present summary is provided only by way of example, and not limitation. Other aspects of the present disclosure will be appreciated in view of the entirety of the present disclosure, including the entire text, claims and accompanying figures.

Figure 1:
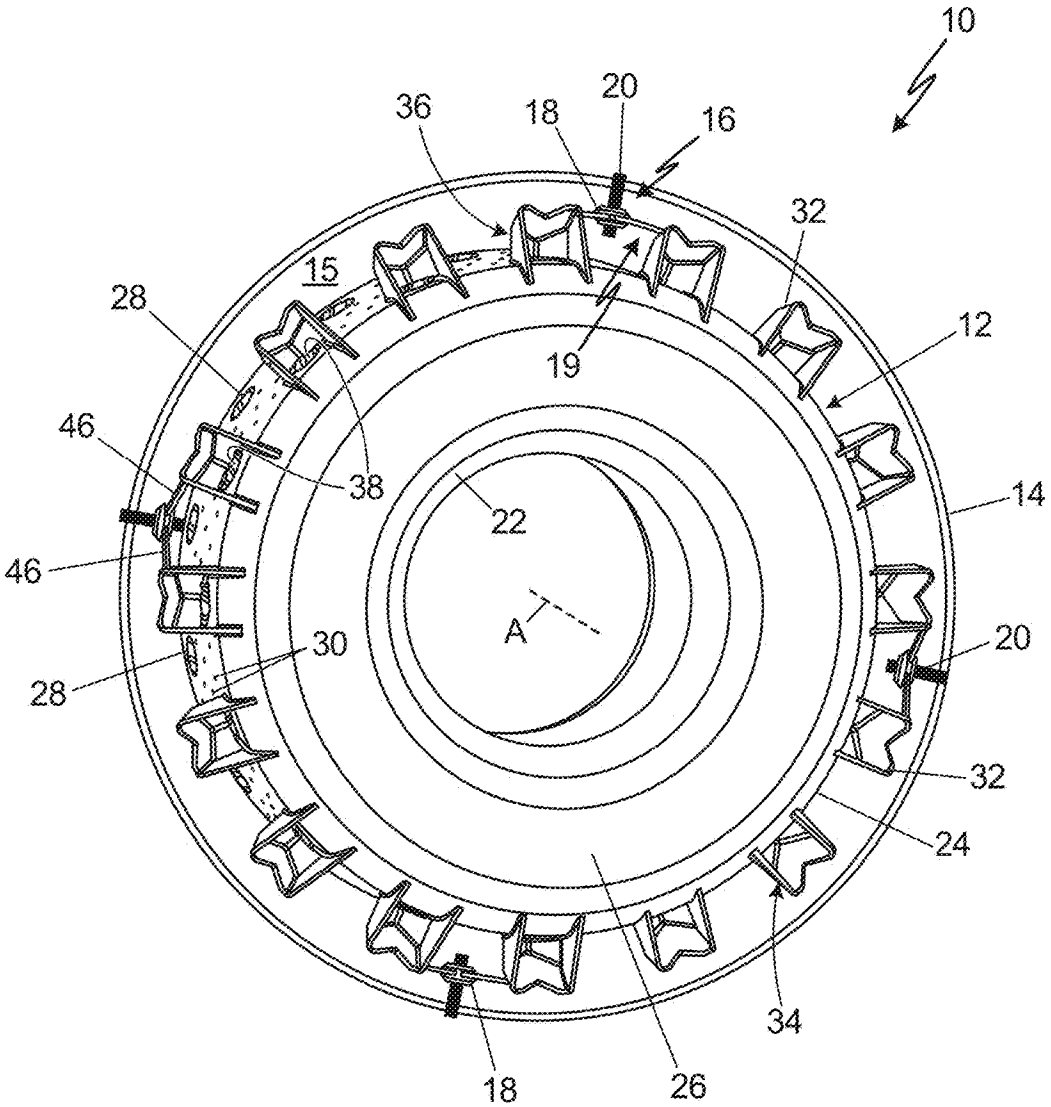
FIG. 1 is a front perspective view of a combustor assembly for a gas turbine engine, showing a combustor liner connected to an outer case, which is shown schematically.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

The disclosed combustor assembly includes features configured to position and locate a combustor liner within an outer case that provide for thermal growth of the combustor liner while minimizing blockage of high-pressure air flow through the outer case and while not affecting fuel delivery to the combustion chamber. As disclosed herein, multiple attachment elements are disposed radially between the combustor liner and the outer case and are configured to slidingly receive radially extending pins that are secured to the outer case. The pins locate the combustor liner radially, circumferentially, and axially within the outer case and allow for radial expansion of the combustor liner with thermal growth.

Figure 2:
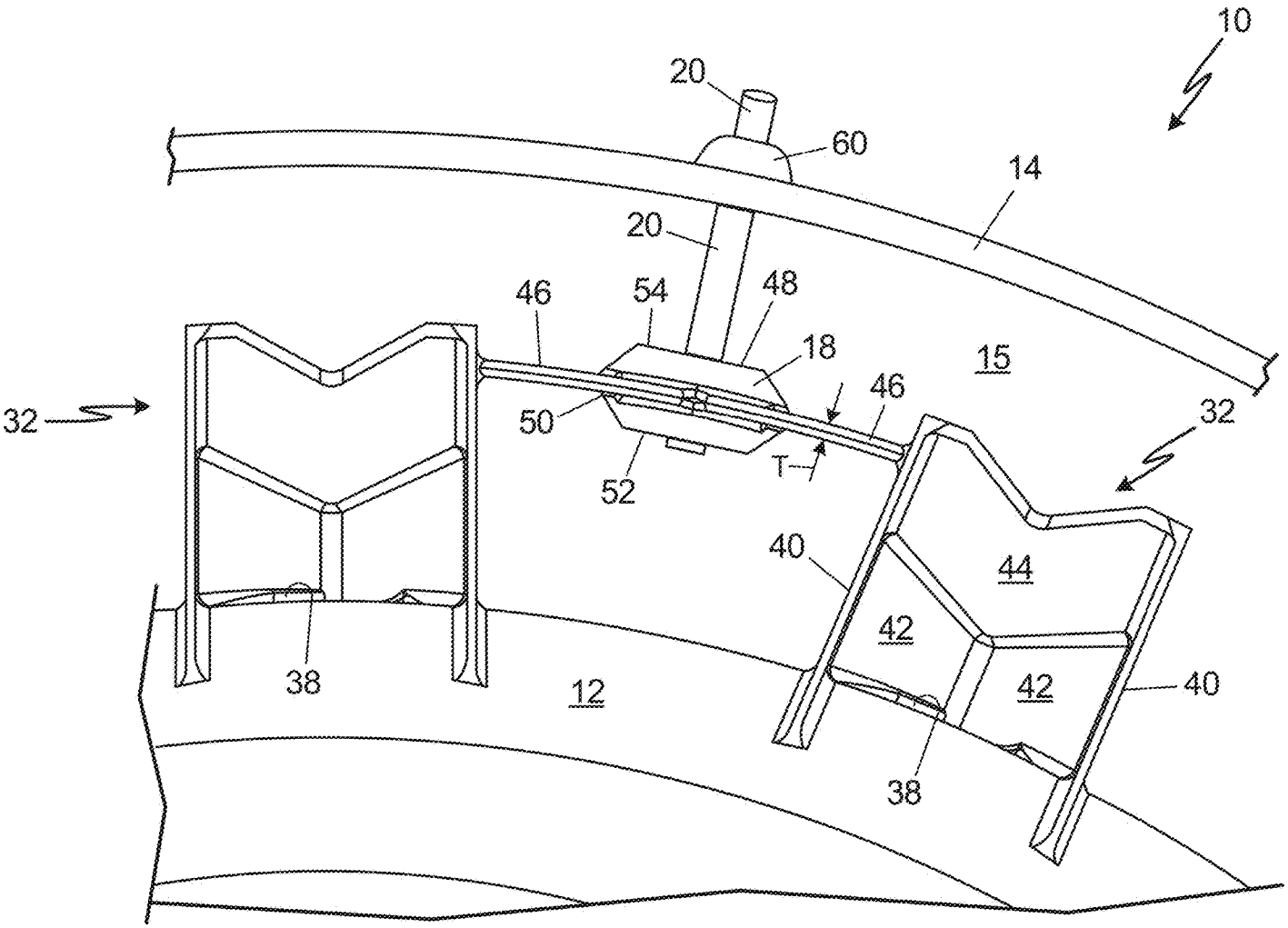
FIG. 2 is an enlarged view of a portion of the combustor assembly of FIG. 1.
Figure 3:
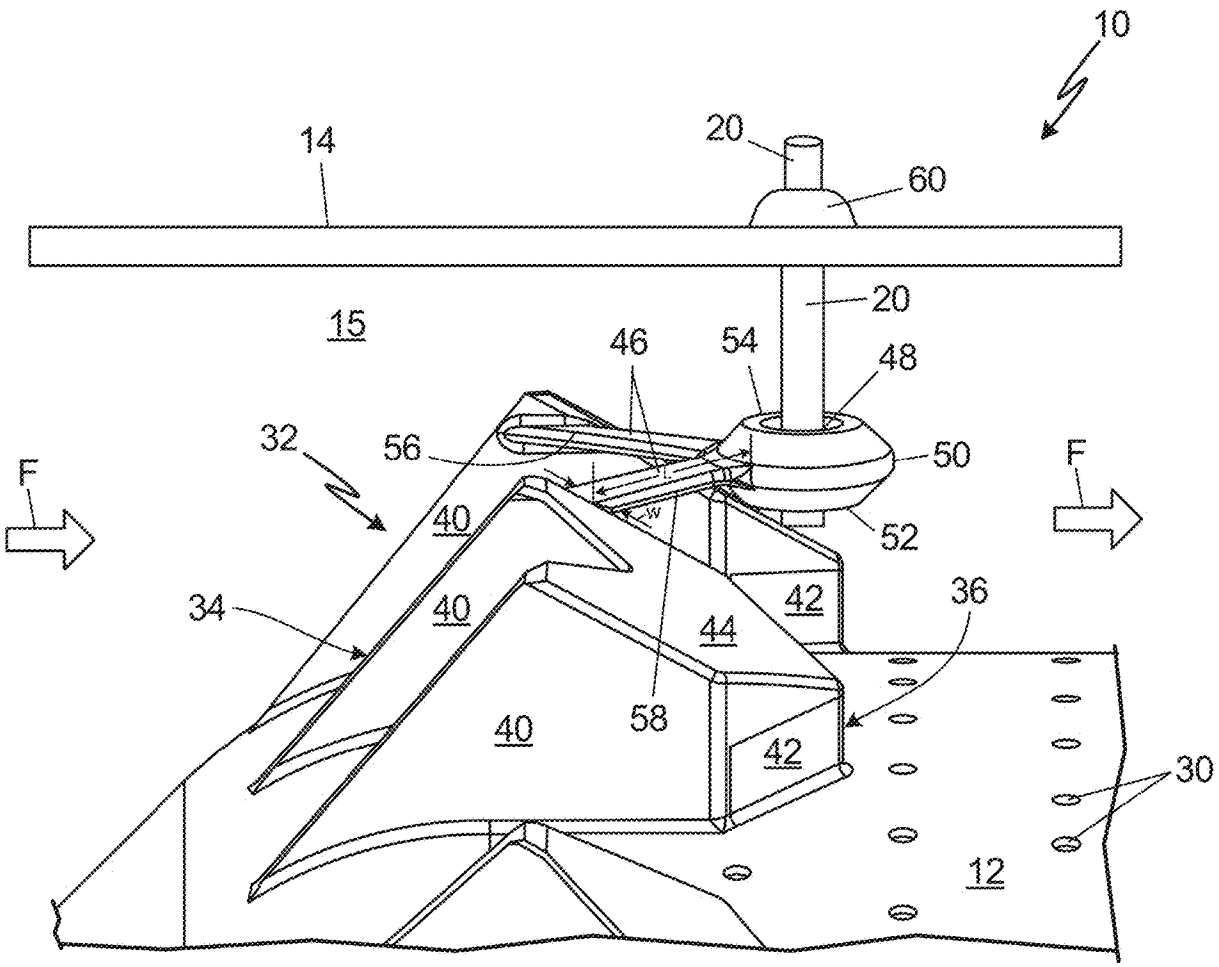
FIG. 3 is an enlarged side view of a portion of the combustor assembly of FIG. 1.

FIG. 1 is a front perspective view of combustor assembly 10 configured for use in a gas turbine engine. FIG. 2 is an enlarged view of a portion of combustor assembly 10 of FIG. 1. FIG. 3 is an enlarged side view of a portion of combustor assembly 10 of FIG. 1. FIGS. 1-3 are discussed together. FIG. 1 shows combustor assembly 10, combustor liner 12, outer case 14, axis A, and a plurality of locating assemblies 16, including attachment elements 18, support elements 19, and pins 20. Combustor liner 12 is disposed about axis A. Outer case 14 is disposed about combustor liner 12. Outer case 14 is shown schematically. The plurality of locating assemblies 16 connect combustor liner 12 and outer case 14 in a manner that radially locates combustor liner 12 within outer case 14 while allowing for radial expansion of combustor liner 12 with thermal growth. Together, combustor liner 12 and outer case 14 define a duct 15 configured to receive high-pressure air (fluid flow F, shown in FIG. 3) from a compressor section of the gas turbine engine.

Combustor liner 12 is an annular body disposed about axis A. Combustor liner 12 defines a combustion chamber. As illustrated in FIG. 1, combustor liner 12 includes an annular inner wall 22 and an annular outer wall 24, defining the combustion chamber therebetween. Inner wall 22 and outer wall 24 can be joined at a forward end to define dome 26. As used herein, the terms "forward" and "aft" refer to a direction of fluid flow F through outer case 14 and about combustor liner 12. Dome 26 can generally define a convex outer forward surface of combustor liner 12.

Combustor liner 12 can include a plurality of dilution holes 28 sized to provide the high-pressure air received from the compressor section into the combustion chamber. As illustrated in FIG. 1, dilution holes 28 can be provided through outer wall 24. Dilution holes 28 can additionally be provided through one or both of inner wall 22 and dome 26. Combustor liner 12 can additionally include a plurality of cooling holes 30. Cooling holes 30 can be sized, for example, to provide film cooling of interior surfaces of combustor liner 12 exposed to hot combustion gases. As illustrated in FIG. 1, cooling holes 30 can be provided through outer wall 24. Cooling holes 30 can additionally be provided through one or both of inner wall 22 and dome 26. Combustor liner 12 opens at an aft end opposite dome 26 to deliver combustion gases to a turbine section of the gas turbine engine.

Combustor liner 12 can include a plurality of inlet scoops 32. Inlet scoops 32 can be configured to capture and guide the high-pressure air received from the compressor section of the gas turbine engine into the combustion chamber. In some embodiments, a subset of the plurality of inlet scoops 32 can be used to additionally deliver fuel from a fuel manifold to the combustor chamber. The plurality of inlet scoops 32 can define a portion of support elements 19 of locating assemblies 16, as discussed further herein. The plurality of inlet scoops 32 can be spaced circumferentially about outer wall 24. The plurality of inlet scoops 32 can be uniformly distributed about outer wall 24. The plurality of inlet scoops 32 can be aligned within an axial plane and disposed adjacent to dome 26 to direct the high-pressure air to a primary combustion zone of the combustion chamber. Inlet scoops 32 are open at a forward end 34 and closed at an aft end 36 to guide the high-pressure air into the combustion chamber. Each inlet scoop 32 partially surrounds an opening 38 through outer wall 24. In some embodiments, openings 38 can be connected to chutes (not shown) that protrude into the combustion chamber to direct the flow of the high-pressure air in the combustion chamber.

Inlet scoops 32 can include a plurality of walls, which can be oriented to increase a velocity of the high-pressure air entering the combustion chamber. In some embodiments, the plurality of walls can include two forward side walls 40, two aft side walls 42, and top wall 44, as best illustrated in FIGS. 2 and 3. Forward side walls 40 are disposed on opposite sides of openings 38 and define, with top wall 44, the opening of inlet scoops 32 at forward end 34. Forward side walls 40 extend radially from combustor liner 12 and axially from forward end 34. Forward side walls 40 of each inlet scoop 32 can extend parallel to one another in an axial direction. Forward ends of forward side walls 40 can slant radially outward from outer wall 24 toward aft end 36. Top ends of forward side walls 40 connected to top walls 44 can slant radially inward from the forward ends toward aft end 36.

Aft side walls 42 extend radially from combustor liner 12 and extend aftward from forward side walls 40. Aft side walls 42 define aft end 36 of inlet scoops 32. Aft side walls 42 can converge in extension from forward side walls and can meet to form a terminal point at aft end 36. Forward ends of aft side walls 42 connect to forward side walls 40. Forward ends of aft side walls 42 can extend orthogonal to outer wall 24. Top ends of aft side walls 42 connected to top walls 44 can slant radially inward from forward side walls 40 to aft end 36.

Top walls 44 connect forward side walls 40 and aft side walls 42 of each inlet scoop 32. Top walls 44 extend in a generally axial direction. A forward end of top walls 44 can be shaped to optimize fluid flow and/or manufacturability. For example, the forward end of top walls 44 can have a chevron-shaped cutout as shown in FIGS. 1-3. Top walls 44 can slope radially inward toward outer wall 24 from forward end 34 to aft end 36. The sloping of top walls 44 and converging of aft side walls 42 can reduce an interior volume of each inlet scoop 32 from forward end 34 to aft end 36 and thereby increase a velocity of the high-pressure air entering the combustion chamber.

The shape of inlet scoops 32 is not limited to the embodiment described herein. Generally, inlet scoops 32 can be configured to surround openings 38 through outer wall 24 on three sides with an opening at a forward end to receive high-pressure air from the compressor section (e.g., a diffuser) disposed axially forward of inlet scoops 32. Inlet scoops 32 can have walls that converge in a forward to aft direction and/or in a radial direction to increase a velocity of the high-pressure air entering the combustion chamber. Walls of inlet scoops 32 can further be configured to minimize or limit disruption of or optimize fluid flow aft of inlet scoops 32. A quantity of inlet scoops 32 can be selected to provide a desired volume of high-pressure air to the primary combustion zone of the combustion chamber.

Inlet scoops 32 can define a portion of support elements 19 to which attachment elements 18 are connected. Inlet scoops 32 can provide radial separation between outer wall 24 of combustor liner 12 and attachment elements 18, such that attachment elements 18 are indirectly attached to combustor liner 12. Attachment elements 18 can be connected to inlet scoops 32 by ligaments 46, which can extend from inlet scoops 32 to attachment elements 18 thereby separating attachment elements 18 from inlet scoops 32.

A plurality of attachment elements 18 can be disposed about combustor liner 12 to locate and retain combustion liner 12 within outer case 14. Attachment elements 18 are configured to receive pins 20. Pins 20 extend radially. Pins 20 are fixed to outer case 14 and slidingly received in attachment elements 18, as described further herein, to accommodate radial expansion of combustor liner 12 with thermal growth. At least three attachment elements 18 are disposed about outer wall 24 to locate and retain the radial, axial, and circumferential position of inner combustor liner 12 within outer case 14. Preferably, attachment elements 18 are uniformly distributed about outer wall 24 of combustor liner 12, however, attachment elements 18 can be non-uniformly distributed about outer wall 24 depending on the number and location of inlet scoops 32. As illustrated in FIG. 1, four attachment elements 18 can be disposed about outer wall 24 at 90-degree increments about axis A such that pairs of attachment elements 18 are disposed 180 degrees from one another about axis A (i.e., within the same radial plane). In other embodiments, more than four attachment elements 18 can be included to provide additional support of combustor liner 12. As described further herein, attachment elements 18 are disposed in the fluid flow path about combustor liner 12 (i.e., duct 15). The number of attachment elements 18 can be selected to support combustor liner 12 while minimizing disruption of fluid flow F about combustor liner 12.

Attachment elements 18 can comprise an annulus with opening 48 sized to slidingly receive pin 20. Openings 48 extend in a radial direction relative to axis A. Openings 48 have a diameter greater than a diameter of pins 20 to accommodate radial movement of attachment elements 18 about pins 20. The diameter of openings 48 can be selected to provide support of combustion chamber defined by combustor liner 12 while allowing attachment elements 18 to freely move along a length of pins 20 with thermal expansion of combustion liner 12. Openings 48 can be through holes extending fully through attachment elements 18 and thereby allowing pins 20 to extend fully through attachment elements 18, as shown in FIGS. 1-3. In other embodiments, openings 48 can be blind holes open to a radially outer surface to receive pins 20 therein and extending through a partial thickness of attachment elements 18 suitable for retaining pins 20 while accommodating thermal growth of combustor liner 12.

Attachment elements 18 can be sized to minimize or limit blockage of fluid flow F through duct 15 while providing a desired structural support of combustor liner 12. In some embodiments, attachment elements 18 can be aerodynamically shaped to minimize or limit fluid flow disruption. For example, as illustrated in FIGS. 2 and 3, attachment elements 18 can be an annulus having a midsection 50 having a greater diameter than ends 52, 54 such that attachment elements 18 taper radially outward relative to an axis of opening 48 from ends 52, 54 toward midsection 50 to efficiently direct fluid flow F about attachment elements 18 and reduce wake formation are recirculation of fluid flow F aft of attachment elements 18.

Attachment elements 18 are not limited to the embodiments disclosed. Attachment elements 18 can have other configurations as described herein and can have other shapes not specifically described. Generally, attachment elements 18 include openings 48 suitable for providing a sliding connection with pins 20 and can have any shape suitable for supporting inner combustor liner. Preferably, attachment elements 18 are shaped to minimize or limit blockage of fluid flow F through duct 15 and promote efficient fluid flow F about attachment elements 18.

Attachment elements 18 can be connected to inlet scoops 32 by ligaments 46. Ligaments 46 can extend axially aft from inlet scoops 32 to attachment elements 18 thereby positioning attachment elements 18 aft of forward ends 34 of inlet scoops 32. In some embodiments, ligaments 46 can be planar bodies having a thickness T measured in a radial direction, width W measured orthogonal to the thickness, and a length L extending from inlet scoops 32 to attachment elements 18. The width W can be uniform or variable along the length L. Each attachment element 18 can be connected to a pair of ligaments 46. Pairs of ligaments 46 can be connected at a forward end to adjacent inlet scoops 32. For example, pairs of ligaments 46 can be connected to forward side walls 40 of adjacent inlet scoops 32. Pairs of ligaments 46 can be connected to inlet scoops 32 at or adjacent to top walls 44 to provide maximum radial separation of attachment elements 18 from outer wall 24 of combustor liner 12.

Ligaments 46 of each pair of ligaments 46 can converge in extension from adjacent inlet scoops 32 to a respective attachment element 18 to centrally locate attachment element 18 between adjacent inlet scoops 32. Ligaments 46 can have a thickness T less than a width W to minimize or limit blockage of fluid flow F through duct 15. In some embodiments, the thickness T can be approximately equal to a thickness of midsection 50 of attachment elements 18, as illustrated in FIGS. 2 and 3. Ligaments 46 can have a thickness T and a width W to provide sufficient rigidity to support combustor liner 12. Ligaments 46 can have a length L selected to locate attachment elements 18 at a desired axial location relative to inlet scoops 32 and to minimize or limit disruption of fluid flow F caused by ligaments 46. For example, the chevron-shaped support defined by converging ligaments 46 of longer length L may provide a more efficient fluid flow F than shorter ligaments 46 that are circumferentially aligned (i.e., extending straight between inlet scoops 32). In some embodiments, attachment elements 18 can be disposed circumferentially between aft ends 36 of adjacent inlet scoops 32. Depending on the shape and size of inlet scoops 32 and attachment locations of ligaments 46, in some embodiments, attachment elements 18 can be positioned forward or aft of aft ends 36 of adjacent inlet scoops 32.

Ligaments 46 can have radiused forward and aft surfaces 56, 58 to promote efficient fluid flow about ligaments 46. Ligaments 46 are not limited to the shape and arrangements shown. In general, ligaments 46 are shaped and oriented to provide a suitable rigidity to support attachment elements 18 and thereby combustor inlet 12 while minimizing or limiting disruption of fluid flow F through duct 15.

Pins 20 are fixed to outer case 14. For example, pins 20 can be received through holes in outer case 14 and threadedly fastened to mounting bosses 60 on an outer surface of outer case 14, as shown schematically in FIGS. 2 and 3. Pins 20 can be removably fixed to outer case 14 by any suitable means know in the art. Ends of pins 20 received in openings 48 of attachment elements 18 can have a smooth outer surface to limit wear on openings 48 caused by contact with walls of openings 48 during operation of the gas turbine engine. Pins 20 can have any configuration suitable for assembly with combustor liner 12 as described herein and attachment to outer case 14.

In assembly, combustor liner 12 can be positioned within outer case 14 such that openings 48 align with pins 20 or holes in outer case 14 configured to receive pins 20. Pins 20 can be inserted through outer case 14 and into openings 48. Pins 20 can be fixed to outer case 14 via threaded fastener or similar fastener suitable for retaining a radial extent of pins 20 into duct 15 and prevent pins 20 from inadvertent disengagement from attachment elements 18 during operation. Together, pins 20 and attachment elements 18 constrain rotation, axial displacement, and radial displacement of combustor liner 12 within outer case 14. Any movement or rotation about x, y, z axes can be limited to movement of pins 20 allowed within openings 48 of attachment elements 18 as defined by the difference in diameters of pins 20 and openings 48.

Combustor liner 12, including attachment elements 18 and support elements 19 (inlet scoops 32 and ligaments 46), can be formed via an additive manufacturing process. For example, combustor liner 12 can be formed via a powder bed fusion additive manufacturing process, such as laser powder bed fusion or electron beam powder bed manufacturing methods. Combustor liner 12 can be built along axis A in the forward to aft direction.

Figure 5:
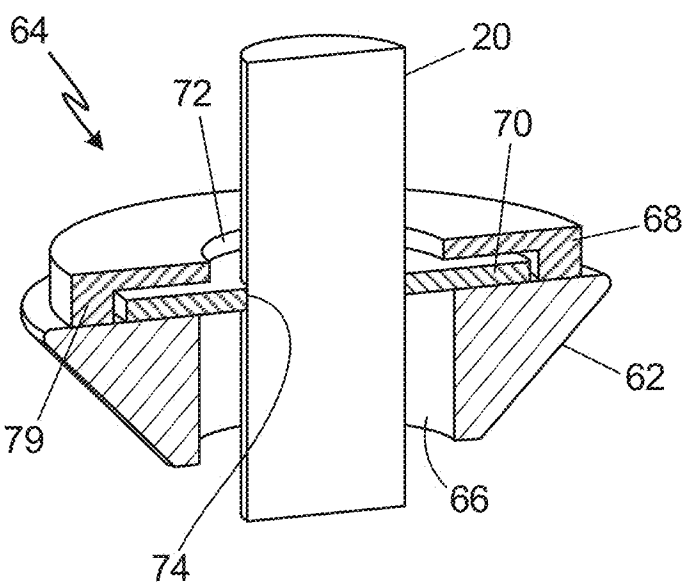
FIG. 5 is a cross-sectional view of the attachment element and pin of FIG. 4.
Figure 4:
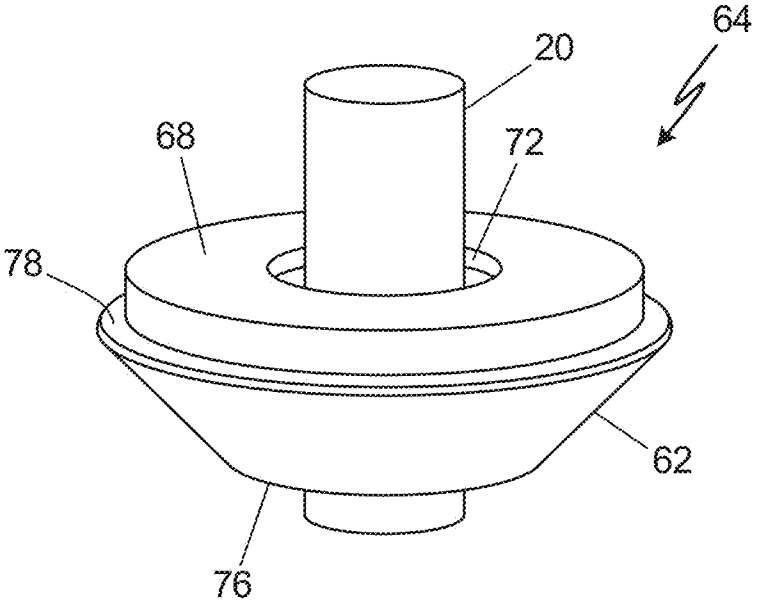
FIG. 4 is a perspective view of an attachment element and pin of a locating assembly for positioning the combustor liner within the outer case.

FIG. 4 is a perspective view of an alternative embodiment of an attachment element for use with pin 20. FIG. 4 shows attachment element 62 with floating collar 64. FIG. 5 is a cross-sectional view of attachment element 62 and floating collar 64 of FIG. 4. FIGS. 4 and 5 are discussed together.

Floating collar 64 is seated on a radially outer surface of attachment element 62. Attachment element 62 includes hole 66. Floating collar 64 includes retention ring 68 and washer 70. Retention ring 68 includes hole 72. Washer 70 includes hole 74. Floating collar 64 is configured to align pin 20 within hole 66 of attachment element 62 while maintaining a gap between pin 20 and walls of hole 66 and allowing for thermal growth of combustor liner 12.

Attachment element 62 can have a shape substantially similar to a radially inner portion of attachment portion 18 of FIGS. 1-3, having an outer wall that tapers radially outward with respect to an axis of hole 66 from end 76 to end 78 to reduce blockage of fluid flow F through duct 15, as previously described, and to promote efficient fluid flow about attachment element 62. End 76 is a radially inner end relative to axis A of combustor liner. End 78 is a radially outer end. End 78 can have a planar surface configured to seat floating collar 64. Hole 66 is sized to receive pin 20 and allow for radial movement of attachment element 62 along a length of pin 20 as previously described. The shape of attachment element 62 is not limited to the embodiment shown. Generally, attachment element 62 includes a hole 66 suitable for providing a sliding connection with pin 20 and can have any shape suitable for supporting inner combustor liner. Preferably, attachment element 62 is shaped to minimize or limit blockage of fluid flow F through duct 15 and promote efficient fluid flow F about attachment element 62.

Floating collar 64 includes retention ring 68 and washer 70. Washer 70 is disposed between floating collar 64 and attachment element 62. Washer 70 can be free to slide within a gap defined between retention ring 68 and attachment element 62. Retention ring 68 can have a cup shape with an annular side wall 79 disposed at an outer diameter and configured to interface with the radially outer surface at end 78 of attachment element 62. Side wall 79 of retention ring 68 can be fixed to attachment element 62. For example, side wall 79 can be welded, brazed, or attached via adhesive to the radially outer surface of end 78. Hole 72 of retention ring 68 is centrally located and sized to receive pin 20. Hole 72 can have a diameter greater than a diameter of hole 74 of washer 70. In some embodiments, hole 72 can have a diameter substantially similar to a diameter of hole 66 of attachment element 62.

Washer 70 is a flat annular ring with centrally located hole 74. Hole 74 has a smaller diameter than hole 66 of attachment element 62. Hole 74 is sized to align pin 20 within hole 66 of attachment element 62 while maintaining a gap between pin 20 and walls of hole 66 while allowing for thermal growth of combustor liner 12. An outer diameter of washer 70 can be less than an inner diameter of side wall 79 of retention ring 68, creating a gap that can allow some radial movement of washer 70 within retention ring 68 with respect to an axis of hole 66. The size of the gap can be selected to provide a desired tolerance for assembly while maintaining a gap between pin 20 and walls of hole 66 during operation.

The locating assemblies disclosed herein are configured to position and locate a combustor liner within an outer case in a manner that allows for thermal growth of the combustor liner while minimizing blockage of high-pressure air flow through the outer case and while not affecting fuel delivery to the combustion chamber. The combustor liner and locating assembly attachment elements and support elements, can be integrally formed via additive manufacturing. The use of three or more of the disclosed locating assemblies can provide radial, axial, and circumferential positioning and retentions of the combustor liner within the outer case while allowing for radial expansion of the combustor liner due to thermal growth. The attachment elements and support elements of the locating assemblies can be shaped and arranged to minimize or limit blockage of fluid flow through the duct and promote fluid flow about the structures.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transient alignment or shape variations induced by thermal, rotational or vibrational operational conditions, and the like. Moreover, any relative terms or terms of degree used herein should be interpreted to encompass a range that expressly includes the designated quality, characteristic, parameter or value, without variation, as if no qualifying relative term or term of degree were utilized in the given disclosure or recitation.

Discussion of Possible Embodiments

The following are non-exclusive descriptions of possible embodiments of the present invention.

In one aspect, a combustor liner for a gas turbine engine is disposed about an axis and defines a combustion chamber. The combustor liner includes a plurality of attachment elements circumferentially spaced about an outer wall of the combustor liner opposite the combustion chamber and a plurality of support elements connecting the plurality of attachment elements to combustor liner such that the plurality of attachment elements is radially spaced from the outer wall of the combustor liner. Each of the plurality of attachment elements includes an opening configured to slidingly receive a pin.

The combustor liner of the preceding paragraph can optionally include, additionally and/or alternatively, any one or more of the following features, configurations, and/or additional components:

In an embodiment of the preceding combustor liner, each of the plurality of attachment elements includes an annulus.

In an embodiment of any of the preceding combustor liners, the opening can be a through hole extending radially through each of the plurality of attachment elements.

In an embodiment of any of the preceding combustor liners, each of the plurality of attachment elements can include a collar configured to receive and align the pin within the opening. The collar can include a retention ring fixed to an outer surface of the attachment element and a washer disposed between the outer surface and the retention ring. The washer can have a through hole having a diameter less than a diameter of the opening.

In an embodiment of any of the preceding combustor liners, the plurality of support elements can include a plurality of inlet scoops extending radially outward from the outer wall of the combustor liner and a plurality of ligaments connecting the plurality of inlet scoops to the plurality of attachment elements. The plurality of inlet scoops can be configured to guide an air flow into the combustion chamber.

In an embodiment of any of the preceding combustor liners, the plurality of ligaments can be connected to the plurality of inlet scoops at a location adjacent to a radially outer end of the plurality of inlet scoops.

In an embodiment of any of the preceding combustor liners, each of the plurality of ligaments can be substantially planar and has a thickness that is less than a width.

In an embodiment of any of the preceding combustor liners, each of the plurality of attachment elements can have a thickness that is greater than the thickness of each of the plurality of ligaments.

In an embodiment of any of the preceding combustor liners, pairs of ligaments of the plurality of ligaments can connect adjacent ones of the plurality of inlet scoops to the plurality of attachment elements.

In an embodiment of any of the preceding combustor liners, the plurality of inlet scoops can extend from a forward end open to the air flow to an aft end and wherein the pairs of ligaments extend axially aft of the forward ends of the plurality of inlet scoops.

In an embodiment of any of the preceding combustor liners, ligaments of each pair of ligaments can converge in extension from the adjacent ones of the plurality of inlet scoops to the respective attachment element.

A combustor assembly for a gas turbine engine can include any of the preceding combustor liners, an outer case disposed about the combustor liner, and a plurality of pins, wherein the plurality of pins are slidingly received in the openings of the plurality of attachment elements and are fixed to the outer case such that the plurality of attachment elements are free to move in a radial direction with along an length of the plurality of pins.

The combustor assembly of the preceding paragraph can optionally include, additionally and/or alternatively, any one or more of the following features, configurations, and/or additional components:

In an embodiment of the preceding combustor assembly, the plurality of support elements can include a plurality of inlet scoops extending radially from an exterior surface of the combustor liner and a plurality of ligaments connecting the plurality of inlet scoops to the plurality of attachment elements. The plurality of inlet scoops can be configured to guide an air flow into the combustion chamber and pairs of ligaments of the plurality of ligaments can connect adjacent ones of the plurality of inlet scoops to the plurality of attachment elements.

In an embodiment of any of the preceding combustor assemblies, the plurality of ligaments can extend axially aft of a forward opening of the plurality of inlet scoops and ligaments of each pair of ligaments can converge in extension from the adjacent ones of the plurality of inlet scoops to one of the plurality of attachment elements.

In an embodiment of any of the preceding combustor assemblies, the plurality of attachment elements can be uniformly distributed about the exterior surface of the combustor liner.

In an embodiment of any of the preceding combustor assemblies, each of the plurality of attachment elements can include an annulus.

In an embodiment of any of the preceding combustor assemblies, the opening can be a through hole extending radially through each of the plurality of attachment elements.

In an embodiment of any of the preceding combustor assemblies, each of the plurality of attachment elements can include a collar configured to receive and align the pin within the opening. The collar can include a retention ring fixed to an outer surface of the attachment element and a washer disposed between the outer surface and the retention ring. The washer can have a through hole having a diameter less than a diameter of the opening.

In another aspect, a combustor assembly for a gas turbine engine includes a combustor liner disposed about an axis and defining a combustion chamber, an outer case disposed about the combustor liner, and a plurality of pins fixed to the outer case. The combustor liner includes a plurality of attachment annuli circumferentially spaced about an outer wall of the combustor liner opposite the combustion chamber and radially spaced from the outer wall of the combustor liner, a plurality of inlet scoops extending radially from the outer wall of the combustor liner, and a plurality of ligaments arranged in pairs with each pair connecting adjacent ones of the plurality of inlet scoops with a respective attachment annulus of the plurality of attachment annuli. Ligaments of each pair of ligaments converge in extension from the adjacent ones of the plurality of inlet scoops to the respective attachment annulus. Each of the plurality of attachment annuli includes a radially extending opening. The plurality of inlet scoops is configured to guide an air flow into the combustion chamber. The plurality of pins is slidingly received in the openings of the plurality of attachment annuli.

In an embodiment of the preceding combustor assembly, the plurality of annuli can be disposed downstream, in an air flow direction, of openings of the plurality of inlet scoops.

The invention claimed is:

1. A combustor liner for a gas turbine engine, the combustor liner disposed about an axis and defining a combustion chamber, the combustor liner comprising:

a plurality of attachment elements circumferentially spaced about an outer wall of the combustor liner opposite the combustion chamber, each of the plurality of attachment elements comprising an opening configured to slidingly receive a pin; and a plurality of support elements connecting the plurality of attachment elements to combustor liner such that the plurality of attachment elements is radially spaced from the outer wall of the combustor liner, the plurality of support elements comprising:

a plurality of inlet scoops extending radially outward from the outer wall of the combustor liner, the plurality of inlet scoops configured to guide an air flow into the combustion chamber; and a plurality of ligaments connecting the plurality of inlet scoops to the plurality of attachment elements, wherein pairs of ligaments of the plurality of ligaments connect adjacent ones of the plurality of inlet scoops to the plurality of attachment elements and wherein ligaments of each pair of ligaments converge in extension from the adjacent ones of the plurality of inlet scoops to a respective attachment element.

2. The combustor liner of claim 1, wherein each of the plurality of attachment elements comprises an annulus.

3. The combustor liner of claim 1, wherein the opening is a through hole extending radially through each of the plurality of attachment elements.

4. The combustor liner of claim 1, wherein each of the plurality of attachment elements comprises a collar configured to receive and align the pin within the opening, wherein the collar comprises:

a retention ring fixed to an outer surface of the attachment element; and a washer disposed between the outer surface and the retention ring, the washer has a through hole having a diameter less than a diameter of the opening.

5. The combustor liner of claim 1, wherein the plurality of ligaments is connected to the plurality of inlet scoops at a location adjacent to a radially outer end of the plurality of inlet scoops.

6. The combustor liner of claim 1, wherein each of the plurality of ligaments is substantially planar and has a thickness that is less than a width.

7. The combustor liner of claim 6, wherein each of the plurality of attachment elements has a thickness that is greater than the thickness of each of the plurality of ligaments.

8. The combustor liner of claim 1, wherein each of the plurality of inlet scoops extends from a forward end open to the air flow to an aft end and wherein the pairs of ligaments extend axially aft of the forward ends of the plurality of inlet scoops.

9. A combustor assembly for the gas turbine engine, the combustor assembly comprising:

the combustor liner of claim 1;

an outer case disposed about the combustor liner; and the pins, wherein the pins are slidingly received in the openings of the plurality of attachment elements and are fixed to the outer case such that the plurality of attachment elements are free to move in a radial direction along a length of the pins.

10. The combustor assembly of claim 9, wherein the plurality of attachment elements are uniformly distributed about the outer wall of the combustor liner.

11. The combustor assembly of claim 9, wherein each of the plurality of attachment elements comprises an annulus.

12. The combustor assembly of claim 11, wherein the opening is a through hole extending radially through each of the plurality of attachment elements.

13. The combustor assembly of claim 12, wherein each of the plurality of attachment elements comprises a collar configured to receive and align the pin within the opening, wherein the collar comprises:

a retention ring fixed to an outer surface of the attachment element; and a washer disposed between the outer surface and the retention ring, the washer has a through hole having a diameter less than a diameter of the opening.

14. A combustor assembly for a gas turbine engine, the combustor assembly comprising:

a combustor liner disposed about an axis and defining a combustion chamber, the combustor liner comprising:

a plurality of attachment annuli circumferentially spaced about an outer wall of the combustor liner opposite the combustion chamber and radially spaced from the outer wall of the combustor liner, each of the plurality of attachment annuli comprising a radially extending opening;

a plurality of inlet scoops extending radially from the outer wall of the combustor liner, the plurality of inlet scoops configured to guide an air flow into the combustion chamber; and a plurality of ligaments arranged in pairs, each pair connecting adjacent ones of the plurality of inlet scoops with a respective attachment annulus of the plurality of attachment annuli, wherein ligaments of each pair of ligaments converge in extension from the adjacent ones of the plurality of inlet scoops to the respective attachment annulus;

an outer case disposed about the combustor liner; and a plurality of pins fixed to the outer case and slidingly received in the radially extending openings of the plurality of attachment annuli.

15. The combustor assembly of claim 14, wherein the plurality of annuli is disposed downstream, in an air flow direction, of openings of the plurality of inlet scoops.

* * * * *